US009939769B2

(12) United States Patent
Yoshida

(10) Patent No.: US 9,939,769 B2
(45) Date of Patent: Apr. 10, 2018

(54) IMAGE FORMING APPARATUS

(71) Applicant: CANON KABUSHIKI KAISHA, Tokyo (JP)

(72) Inventor: Michihiro Yoshida, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/226,319

(22) Filed: Aug. 2, 2016

(65) Prior Publication Data

US 2017/0052494 A1 Feb. 23, 2017

(30) Foreign Application Priority Data

Aug. 18, 2015 (JP) ..... 2015-160929

(51) Int. Cl.
*G03G 15/02* (2006.01)
*G03G 15/00* (2006.01)

(52) U.S. Cl.
CPC ..... *G03G 15/553* (2013.01); *G03G 15/0258* (2013.01); *G03G 15/5016* (2013.01); *G03G 15/556* (2013.01)

(58) Field of Classification Search
CPC .... G03G 15/55; G03G 15/553; G03G 15/556; G03G 15/0258
See application file for complete search history.

(56) References Cited

U.S. PATENT DOCUMENTS 6,324,357 B1 11/2001 Gomi et al.
2004/0136735 A1* 7/2004 Jeong ..... G03G 15/553 399/24
2009/0052912 A1* 2/2009 Soji ..... G03G 15/55 399/31
2011/0182596 A1* 7/2011 Ishii ..... G03G 15/50 399/31

FOREIGN PATENT DOCUMENTS

JP 09-211931 A 8/1997
JP 10-133456 A 5/1998
JP 2001-013850 A 1/2001
JP 2003-195700 A 7/2003

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member bearing an electrostatic latent image formed based on image information in forming an image, an electrification member being in contact with a surface of the image bearing member to electrify the image bearing member, a service life determining portion determining whether or not a service life of the electrification member has come to its end based on information concerning an electrification time during which voltage is applied to the electrification member obtained by using a detection result of the environment detecting portion and information concerning an image ratio of a formed image obtained by using the detection result of the environment detecting portion, and an alarm portion issuing an alarm in response to a determination made by the service life determining portion that the service life of the electrification member has come to the end.

41 Claims, 6 Drawing Sheets

IMAGE FORMING APPARATUS

BACKGROUND OF THE INVENTION

Field of the Invention

The present invention relates to an image forming apparatus forming an image and more specifically to an image forming apparatus including an electrification unit electrifying a surface of an image bearing member such as a photosensitive drum.

Description of the Related Art

Conventionally, an electro-photographic image forming apparatus is widely applied as a copier, a printer, a facsimile machine, and a multi-function printer having a plurality of functions of those apparatuses. Such image forming apparatus adopts a process of electrifying a surface of a photosensitive drum, i.e., an image bearing member, by an electrification roller, of exposing the electrified surface by a laser scanner to form an electrostatic latent image, of applying toner to the electrostatic latent image by a developing unit to form a toner image, and of transferring the toner image onto a sheet to visualize the image.

In order to continuously form favorable images by such image forming apparatus, it is required to replace components thereof in accordance with a service life set for each individual unit and member. For instance, one of factors shortening a service life of an electrification roller, i.e., an electrification member, is an electrification failure of the electrification roller caused by toner external additive depositing non-homogeneously on a surface of the electrification roller. Therefore, as a method for estimating an amount of the external additive depositing on the electrification roller (referred to an 'additive deposition amount' hereinafter), a method of detecting that an integrated value of an electrification voltage applied time and an integrated value of a number of rotations of the electrification roller have reached predetermined reference values is developed as disclosed in Japanese Patent Application Laid-open No. Hei. 09-211931, for example. In the image forming apparatus adopting this method, a control portion of the image forming apparatus determines whether or not those values of the electrification roller have reached the reference values and if the control portion determines that those values have reached the reference values, the control portion alarms a user of the image forming apparatus that a time for replacing the electrification roller has come.

However, because the image forming apparatus disclosed in Japanese Patent Application Laid-open No. Hei. 09-211931 estimates the external additive deposition amount on the electrification roller based on the integrated value of the electrification voltage applied time and the integrated value of the number of rotations of the electrification roller, the additive deposition amount varies considerably and may be considerably different from an actual external additive deposition amount. That is, because the amount of the external additive depositing on the electrification roller per unit time varies depending on an image ratio and a usage environment, there is a case when the integrated value of the electrification voltage applied time and the integrated value of the number of rotations of the electrification roller do not correctly reflect the deposition amount depending on an actual use condition.

SUMMARY OF THE INVENTION

The invention provides an image forming apparatus capable of estimating a service life of an electrification member with high accuracy.

According to one aspect of the invention, an image forming apparatus includes an apparatus body, an image bearing member arranged within the apparatus body, an electrification member arranged within the apparatus body and configured to be in contact with a surface of the image bearing member to electrify the image bearing member, an electrostatic latent image forming portion arranged within the apparatus body and configured to form an electrostatic latent image on the electrified image bearing member based on image information, an image forming portion arranged within the apparatus body and configured to form an image on a recording medium based on the electrostatic latent image formed on the image bearing member, an environment detecting portion configured to detect environmental information within the apparatus body, a service life determining portion configured to determine whether or not a service life of the electrification member has come to its end based on information concerning an electrification time during which voltage is applied to the electrification member obtained by using a detection result of the environment detecting portion and information concerning an image ratio of a formed image obtained by using the detection result of the environment detecting portion, and an alarm portion configured to issue an alarm in response to a determination made by the service life determining portion that the service life of the electrification member has come to the end.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Embodiments of the present disclosure will be described below in detail with reference to FIGS. 1 through 4. A tandem type full-color printer will be described as an exemplary image forming apparatus 1 in the following embodiments. However, the present disclosure is not limited to the image forming apparatus 1 and may be an image forming apparatus of another type. Still further, the present disclosure is not limited to be a full-color printer and may be a monochrome or mono-color printer.

Figure 1:
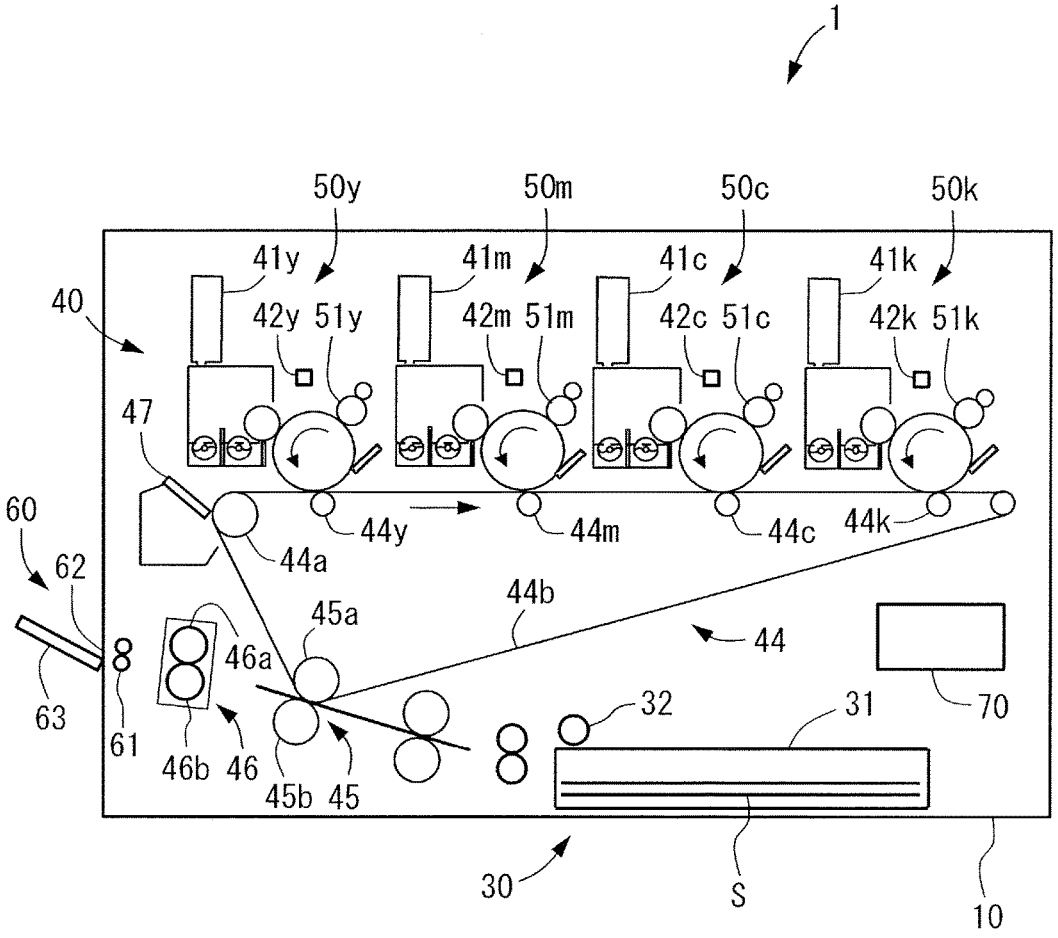
FIG. 1 is a section view schematically illustrating an image forming apparatus of an embodiment.

As illustrated in FIG. 1, the image forming apparatus 1 includes an apparatus body 10, a sheet feed portion 30, an image forming portion 40, a sheet conveyance portion (not illustrated), a sheet discharge portion 60, a control portion 70 and an operating portion (not illustrated). It is noted that a sheet S, i.e., a recording medium, is that on which a toner image is formed and may be a plain sheet, a synthetic resin sheet, i.e., a substitute of the plain sheet, a thick sheet, an overhead projector sheet, or the like.

The sheet feed portion 30 is disposed at a lower part of the apparatus body 10 and includes a sheet cassette 31 stacking and storing the sheet S and a feed roller 32 feeding the sheet S to the image forming portion 40.

The image forming portion 40 includes image forming units 50*y*, 50*m*, 50*c* and 50*k*, toner bottles 41*y*, 41*m*, 41*c* and 41*k*, exposure units 42*y*, 42*m*, 42*c* and 42*k*, an intermediate transfer unit 44, a secondary transfer portion 45 and a fixing portion 46. The image forming portion 40 is configured to form an image on the sheet S based on image information. It is noted that the image forming apparatus of the present embodiment is accommodated in a full-color printer, and the image forming units 50*y*, 50*m*, 50*c* and 50*k* are provided separately for four colors of yellow (y), magenta (m), cyan (c) and black (k), respectively, with a similar configuration. Therefore, although four color components are denoted by identifiers of the four colors appended after reference numerals of the respective components in FIG. 1, each component will be described in FIG. 2 and in the following specification only by the reference numeral without appending the color identifiers.

The toner bottles 41*y*, 41*m*, 41*c* and 41*k* are disposed at an upper part of the respective image forming units 50*y*, 50*m*, 50*c* and 50*k*. In the present embodiment, the toner has an average particle size of about 6 μm obtained by crushing and classifying resin binder mainly composed of polyester to which pigment is kneaded.

Figure 2:
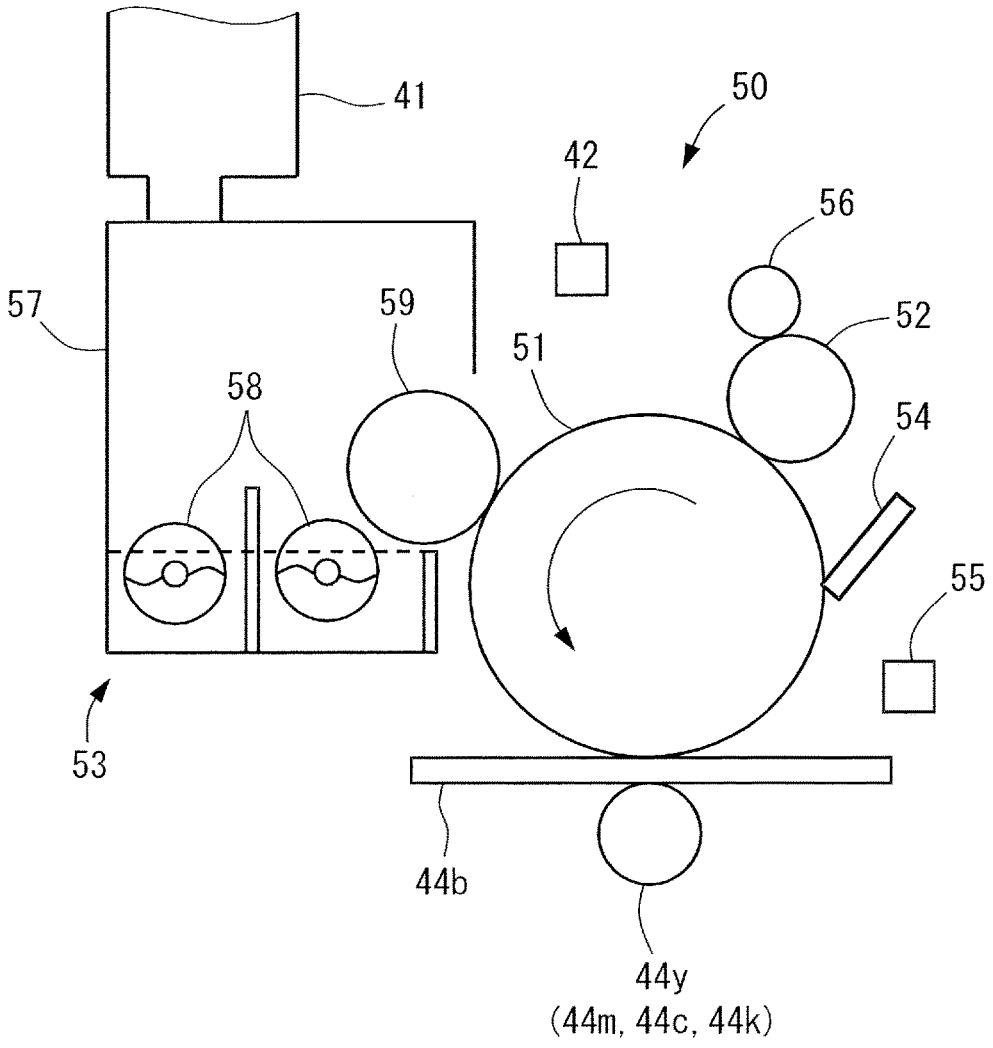
FIG. 2 is a section view schematically illustrating an image forming unit of the image forming apparatus of the present embodiment.

The image forming unit 50 includes the four image forming units 50*y*, 50*m*, 50*c* and 50*k* to form four toner images. As illustrated in FIG. 2, each image forming unit 50 includes a photosensitive drum 51, i.e., an image bearing member, an electrification roller 52, i.e., an electrification member, a developing unit 53, a cleaning blade 54, i.e., a cleaning portion, and a pre-exposure portion 55. According to the present embodiment, the image forming unit 50 is attachable to/detachable from the apparatus body 10. However, the present disclosure is not limited to such configuration, and only the electrification roller 52 may be attachable to/detachable from the apparatus body 10 or only the electrification roller 52 and the photosensitive drum 51 may be integrally attachable to/detachable from the apparatus body 10.

The photosensitive drum 51 circularly moves while bearing an electrostatic latent image formed based on image information in forming an image. The photosensitive drum 51 is rotated by a drum motor. The photosensitive drum 51 is also provided with a memory portion 51*a* (see FIG. 3).

The electrification roller 52 comes into contact with and electrifies the surface of the photosensitive drum 51. The electrification roller 52 is provided with an electrification roller cleaning member 56. The electrification roller 52 is provided per each color, and ON-OFF control of the respective electrification voltages is carried out by an electrification high voltage control portion 80, i.e., a driver, by receiving commands from the control portion 70 (see FIG. 3).

The developing unit 53 includes a developer container 57 storing two-component developer in which non-magnetic toner is blended with magnetic carrier, an agitation screw 58, and a developing sleeve 59, i.e., a developer bearing member, provided rotatably at an opening of the developer container 57. The developing sleeve 59 magnetically retains the developer within the developer container 57 by a magnet fixedly disposed within the developing sleeve 59 and conveys the developer to a gap portion with the photosensitive drum 51.

The toner is supplied to the developer container 57 from the toner bottle 41 in which toner is filled. The toner is frictionally electrified to have a negative polarity by frictionally sliding with the magnetic carrier. The developing sleeve 59 is connected with a high voltage power supply (not illustrated) that applies a developing bias in which DC and AC voltages are superimposed. The developing sleeve 59 executes a developing process by applying the toner on the electrostatic latent image by the developing bias.

The cleaning blade 54 is disposed in contact with the surface of the photosensitive drum 51 and cleans the developer left on the surface of the photosensitive drum 51 after the primary transfer process. The cleaning blade 54 is made of urethane rubber, for example, and is supported by being attached to a metallic support plate (not illustrated). The cleaning blade 54 is supported to the apparatus body 10 through the support plate so as to come into contact with the surface of the photosensitive drum 51 with a predetermined contact pressure (or linear pressure coefficient).

After the primary transfer, the surface of the photosensitive drum 51 is destaticized by a pre-exposure portion 55. After that, the cleaning blade 54 removes the residual substances such as the transfer residual toner left on the surface of the photosensitive drum 51 from the surface of the photosensitive drum 51.

As illustrated in FIG. 1, the intermediate transfer unit 44 is disposed under the image forming units 50*y*, 50*m*, 50*c* and 50*k*. The intermediate transfer unit 44 includes a plurality of rollers such as a driving roller 44*a*, a driven roller (not illustrated), and primary transfer rollers 44*y*, 44*m*, 44*c* and 44K, and an intermediate transfer belt 44*b* wrapped around these rollers. The primary transfer rollers 44*y*, 44*m*, 44*c* and 44K are disposed so as to face, respectively, photosensitive drums 51*y*, 51*m*, 51*c* and 51*k* and to be in contact with the intermediate transfer belt 44*b*.

A tensile force above a certain level is applied to the intermediate transfer belt 44*b* even when the intermediate transfer belt 44*b* is not driven, and the intermediate transfer belt 44*b* is always in contact with the photosensitive drums 51*y*, 51*m*, 51*c* and 51*k*. The toner images respectively having the negative polarity on the photosensitive drums 51*y*, 51*m*, 51*c* and 51*k* are superimposed and transferred sequentially onto the intermediate transfer belt 44*b* by a transfer bias of positive polarity applied to the intermediate transfer belt 44*b* by the primary transfer rollers 44*y*, 44*m*, 44*c* and 44K. Thereby, the toner images obtained by developing the electrostatic images on the surfaces of the photosensitive drums 51*y*, 51*m*, 51*c* and 51*k* are transferred onto and moved by the intermediate transfer belt 44*b*.

The secondary transfer portion 45 includes a secondary transfer inner roller 45*a* and a secondary transfer outer roller 45*b*. A full-color image formed on the intermediate transfer belt 44*b* is transferred onto the sheet S by a secondary transfer bias of positive polarity applied to the secondary transfer outer roller 45*b*. It is noted that the secondary transfer inner roller 45*a* stretches the intermediate transfer belt 44*b* on an inside of the endless intermediate transfer belt 44*b*, and the secondary transfer outer roller 45*b* is provided at a position facing the secondary transfer inner roller 45*a* across the intermediate transfer belt 44*b*.

The fixing portion 46 includes a fixing roller 46*a* and a pressure roller 46*b*. The toner image transferred onto the sheet S is heated and pressed, i.e., is fixed to the sheet S, by being nipped and conveyed between the fixing roller 46*a* and the pressure roller 46*b*.

The sheet discharge portion 60 includes a discharge roller pair 61 disposed downstream of a discharge path, and a discharge port 62 and a discharge tray 63 disposed on a side part of the apparatus body 10. The discharge roller pair 61 is configured to feed the sheet S by a nip portion thereof to discharge out of the discharge port 62. The sheet S discharged out of the discharge port 62 is stacked on the discharge tray 63.

Figure 3:
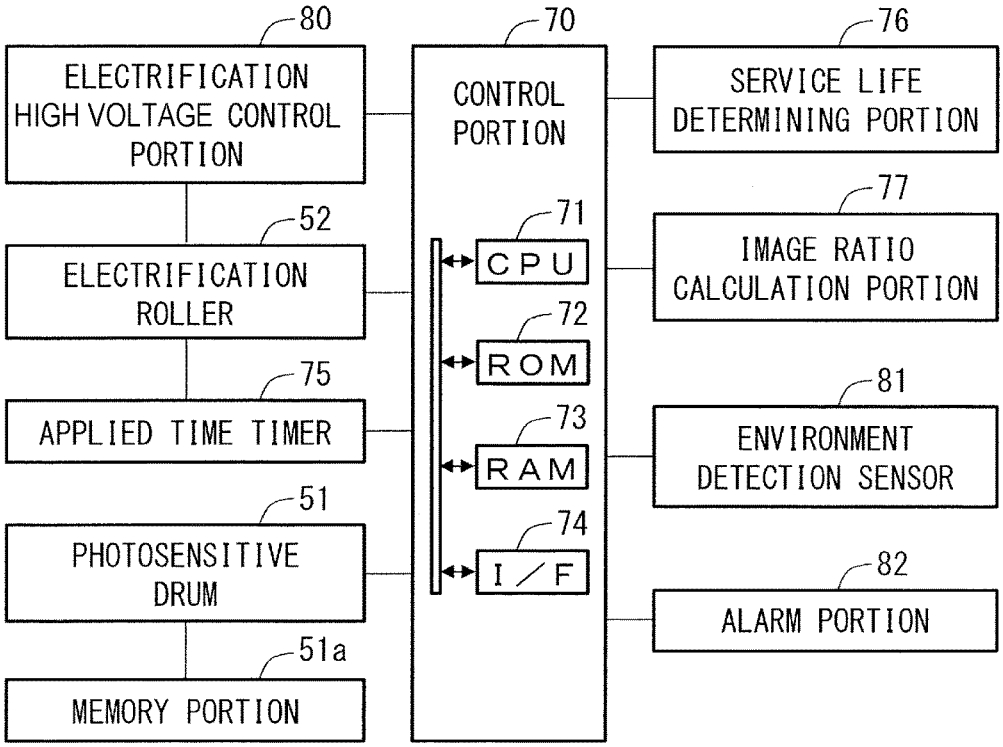
FIG. 3 is a block diagram of a control portion of the image forming apparatus of the present embodiment.

As illustrated in FIG. 3, the control portion 70 is composed of a computer and includes, for example, a CPU 71, a ROM 72 storing programs controlling the respective portions, a RAM 73 temporarily storing data, and an input/output circuit (I/F) 74 inputting/outputting signals from/to outside. The CPU 71 is a microprocessor administering overall control of the image forming apparatus 1 and is a main body of a system controller. The CPU 71 is connected with the sheet feed portion 30, the image forming portion 40, the sheet conveyance portion, the sheet discharge portion 60, and the operating portion through the input/output circuit 74 and exchanges signals with the respective portions to control their operations.

The control portion 70 is connected with an electrification high voltage control portion 80, a driving portion (not illustrated) of the electrification roller 52, an applied time timer, i.e., measuring portion, 75 and a driving portion (not illustrated) of the photosensitive drum 51. The control portion 70 controls a voltage applied to the electrification roller 52 through the electrification high voltage control portion 80. The applied time timer 75 measures an applied time of the electrification voltage applied to the electrification roller 52 and transmits measurement results to the CPU 71.

The control portion 70 is connected also with a service life determining portion 76, an image ratio calculation portion 77, an environment detection sensor, i.e., environment detecting portion, 81 and an alarm portion 82. The image ratio calculation portion 77 calculates an image ratio based on image information of an image to be formed. The environment detection sensor 81 detects ambient environmental information of the electrification roller 52. According to the present embodiment, the environment detection sensor 81 detects temperature and humidity as the ambient environmental information of the electrification roller 52. It is noted that although the service life determining portion 76 and the image ratio calculation portion 77 are provided separately from the control portion 70, the present disclosure is not limited to such arrangement and the service life determining portion 76 and the image ratio calculation portion 77 may be provided as parts of the control portion 70.

The service life determining portion 76 determines whether or not a service life of the electrification roller 52 has come to its end based on the applied time of the electrification voltage applied to the electrification roller 52, the ambient environmental information of the electrification roller 52, the image ratio, and a linear pressure of the cleaning blade 54 on the photosensitive drum 51. As described above, the applied time timer 75 obtains the applied time of the electrification voltage applied to the electrification roller 52, the environment detection sensor 81 obtains the ambient environmental information of the electrification roller 52, and the image ratio calculation portion 77 obtains the image ratio. The linear pressure of the cleaning blade 54 on the photosensitive drum 51 is measured in advance and is stored in the memory portion 51*a* or the ROM 72. An exemplary service life determination method of the service life determining portion 76 will be described later. An alarm portion 82 issues an alarm when the service life determining portion 76 determines that the service life of the electrification roller 52 has come to the end. The alarm issued by the alarm portion 82 is an error message displayed on an operation panel informing the user that the replacement time of the electrification roller 52 has come, for example.

Still further, according to the present embodiment, when the electrification voltage applied time and the image ratio are constant, respectively, the alarm portion 82 issues the alarm that the service life of the electrification roller 52 has come to the end earlier in a case when an absolute moisture amount, i.e., the environmental information, is high as compared to a case when the absolute moisture amount is low. Still further, according to the present embodiment, when the electrification voltage applied time and the absolute moisture amount, i.e., the environment information, are constant, respectively, the alarm portion 82 issues the alarm that the service life of the electrification roller 52 has come to its end earlier in a case when the image ratio is high as compared to a case when the image ratio is low.

Figure 4:
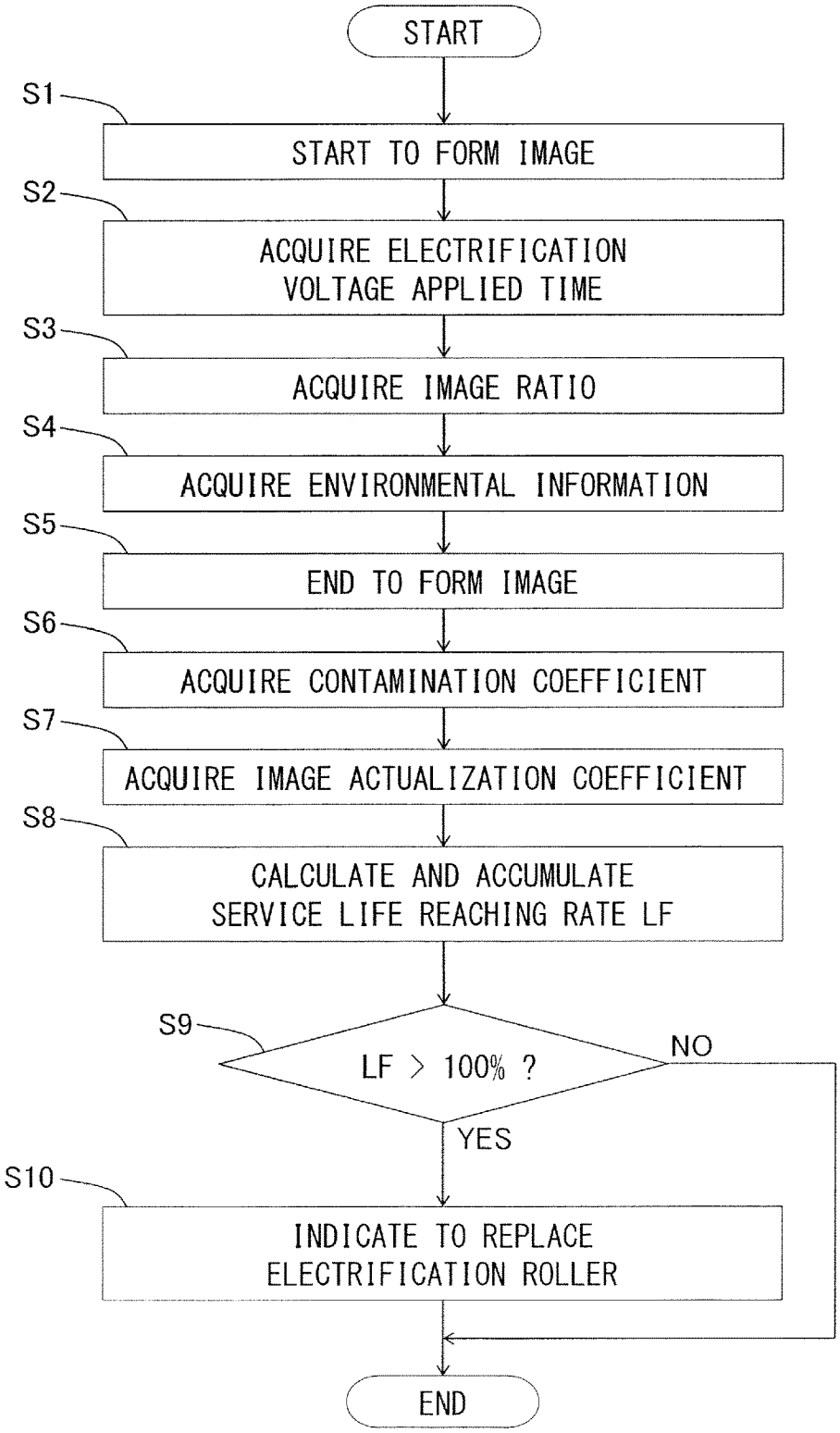
FIG. 4 is a flowchart illustrating a service life determining process of the image forming apparatus of the present embodiment.

Next, steps for detecting the service life of the electrification roller 52 in the image forming apparatus 1 described above will be described along a flowchart shown in FIG. 4.

The control portion 70 starts to form an image based on image information of an image to be formed in step S1. At this time, the control portion 70 applies an electrification voltage to the electrification roller 52 by the electrification high voltage control portion 80 to electrify the surface of the photosensitive drum 51. Then, the control portion 70 acquires an electrification voltage applied time obtained by the applied time timer 75 and stores in the memory portion 51*a* or the RAM 73 in step S2.

The control portion 70 also acquires an image ratio of the image obtained by the image ratio calculation portion 77 and stores in the RAM 73 in step S3. Still further, the control portion 70 acquires environmental information of ambient temperature and humidity of the electrification roller 52 obtained by the environment detection sensor 81, finds an absolute moisture amount by using a map or a conversion expression set in advance, and stores its value in the RAM 73 in step S4. After that, the control portion 70 finishes the image forming process of the image in step S5.

Next, the control portion 70 acquires a contamination coefficient $\alpha$ in step S6. The contamination coefficient $\alpha$ is a coefficient indicating easiness of contamination of the electrification roller 52 per each environment. The contamination coefficient $\alpha$ is a parameter determined in advance by an adhesion force adhering the toner external additive of the electrification roller 52, a voltage applied to the electrification roller 52, an adhesion force adhering the toner external additive of the photosensitive drum 51, a force of the cleaning blade 54 scraping the toner external additive from the photosensitive drum 51, and others. In the present embodiment, the contamination coefficient $\alpha$ is found by using the following Table 1 from a relationship between the environmental information and the image ratio:

TABLE 1

| | | | ENVIRONMENT (CLASSIFICATION/ ABSOLUTE MOISTURE AMOUNT (g/kgDA)) | | | | | | |
|---|---|---|---|---|---|---|---|---|---|
| | | | A 0.86 | B 1.73 | C 5.80 | D 8.90 | E 15.0 | F 18.0 | G 21.6 |
| IMAGE RATIO (CLASSIFICATION/%) | A | 0 | 0.80 | 0.88 | 1.07 | 1.27 | 1.59 | 1.79 | 1.99 |
| | B | 2 | 0.80 | 0.88 | 1.07 | 1.27 | 1.59 | 1.79 | 1.99 |
| | C | 5 | 1.00 | 1.10 | 1.35 | 1.60 | 2.00 | 2.25 | 2.50 |
| | D | 10 | 1.02 | 1.12 | 1.38 | 1.63 | 2.04 | 2.30 | 2.55 |
| | E | 20 | 1.06 | 1.17 | 1.43 | 1.70 | 2.12 | 2.39 | 2.65 |
| | F | 50 | 1.08 | 1.19 | 1.46 | 1.73 | 2.16 | 2.43 | 2.71 |
| | G | 100 | 1.10 | 1.21 | 1.49 | 1.77 | 2.21 | 2.48 | 2.76 |

Specifically, the control portion 70 classifies the environment into seven stages of environment classes A through G in accordance with the value of the absolute moisture amount acquired in step S4. The control portion 70 also classifies the image ratio into seven stages of image ratio classes A through G in accordance with the value of the image ratio obtained in step S3. Then, the control portion 70 acquires the contamination coefficient α from the environment classes A through G and the image ratio classes A through G by making reference to Table 1. That is, the control portion 70 calculates the contamination coefficient α as information concerning the image ratio of the formed image calculated by adapting the detection result of the environment detection sensor 81.

As indicated in Table 1, the environment class A is a low temperature and low humidity environment (the absolute moisture amount is 0.86 g/kgDA or less) and the environment class G is a high temperature and high humidity environment (the absolute moisture amount is 21.6 g/kgDA or more). Still further, between the environment classes in Table 1, the contamination coefficient α is used by adopting linear interpolation. The image ratio of the image ratio class A is set to be 0% and the image ratio of the image ratio class G to be 100%. Similarly to the environment class, the contamination coefficient α is used by adopting linear interpolation between the image ratio classes.

Here, an environmental factor considerably affects the adhesion force of the toner external additive. The adhesion force of the toner external additive of the electrification roller 52 increases in the environment class G in particular. Still further, because corona products and moisture adhere on the photosensitive drum 51, the friction force with the cleaning blade 54 increases, and micro vibration is generated in the environment class G, the toner external additive is apt to slip through a gap between the cleaning blade 54 and the photosensitive drum 51. Due to that, the contamination coefficient α is set to be large on a side of the environment class G more than that of the environment class A. That is, in the case when the electrification voltage applied time and the image ratio are constant, respectively, the alarm portion 82 issues the alarm that the service life of the electrification roller 52 has come to the end earlier in the case when the absolute moisture amount, i.e., the environment information, is high as compared to the case when the absolute moisture amount is low.

Still further, because an amount of toner conveyed toward the cleaning blade 54 increases in a case when the image ratio is high as compared to a case when the image ratio is low, an amount of toner external additive slipping through the gap between the cleaning blade 54 and the photosensitive drum 51 increases accordingly. Due to that, the contamination coefficient α is set to be large on a side of the image ratio class G as compared to that in the image ratio class A. That is, in the case when the electrification voltage applied time and the absolute moisture amount, i.e., the environmental information, are constant, respectively, the alarm portion 82 issues the alarm that the service life of the electrification roller 52 has come to the end earlier in the case when the image ratio is high as compared to the case when the image ratio is low.

Still further, because the contamination coefficient α varies considerably in a case when the environmental information or the image ratio fluctuates considerably, it is also possible to arrange so as to use a value flattened by using a running average among a predetermined number of sheets of around 1000 sheets for example.

Next, the control portion 70 acquires an image actualization coefficient β in step S7. In the present embodiment, the image actualization coefficient β is found in connection with the environmental information by using the following Table 2:

TABLE 2

| | ENVIRONMENT CLASSIFICATION ABSOLUTE MOISTURE AMOUNT (g/kgDA) | | | | | | |
|---|---|---|---|---|---|---|---|
| | A 0.86 | B 1.73 | C 5.80 | D 8.90 | E 15.0 | F 18.0 | G 21.6 |
| β | 1.0 | 1.2 | 1.4 | 1.6 | 2.2 | 2.8 | 3.2 |

Specifically, the control portion 70 finds an absolute moisture amount from temperature and humidity obtained in step S4 by using a map or conversion expression set in advance and classifies the environment into seven stages of environment classes A through Gin accordance with the value of the absolute moisture amount thus obtained. Then, the control portion 70 acquires the image actualization coefficient β by making reference to the environment classes A through G of Table 2. That is, the control portion 70 calculates the image actualization coefficient β to acquire information t/β related to the electrification time t during which a voltage is applied to the electrification roller 52 by adapting the detection result of the environment detection sensor 81.

The image actualization coefficient β is a coefficient of easiness of actualization of the toner external additive into an image when the additive deposits on the electrification roller 52 and is caused by surface nature and physical property of the electrification roller 52, the developer and its developing characteristics, and their environmental characteristics. Resistance of the electrification roller 52 tends to be high in the environment class A (low temperature and low humidity), so that contamination is assumed to be easily actualized in an image even if there is less contamination. The resistance of the electrification roller 52 tends to be low and the electrification roller 52 has high electrifying ability in the environment class G (high temperature and high humidity), so that contamination is assumed to be hardly actualized in an image even if there is much contamination.

Still further, because the image actualization coefficient β varies considerably in a case when the environmental information fluctuates considerably, it is possible to arrange so as to use a value flattened by using a running average among a predetermined number of sheets of around 1000 sheets for example.

Then, the service life determining portion 76 calculates and accumulates a service life reaching rate LF in the image in step S8. In the present embodiment, the service life determining portion 76 calculates the service life reaching rate LF by the following Equation 1. The service life reaching rate LF is an achievement ratio defining a level of contamination of the electrification roller 52 causing a defective image as 100% and is calculated per each image to be formed.

$$LF=C\times\alpha\times t/(T\text{sum}\times\beta)\times 100 \quad \text{Eq. 1}$$

Where LF is the service life reaching rate (%), C is a coefficient of the cleaning blade, α is the contamination coefficient, t is the electrification voltage applied time (sec), Tsum is a predetermined electrification time (sec), and β is the image actualization coefficient.

The predetermined electrification time Tsum is an electrification time by which the service life has come to its end in a predetermined job. In the present embodiment, it is the electrification time Tsum at a point of time when the service life has come to the end after repetitively carrying out intermittent jobs of five sheets and is specifically 428750 seconds for example. Still further, t/β is calculated as information concerning the electrification time t during which the voltage is applied to the electrification roller 52 obtained by adapting the detection result of the environment detection sensor 81.

If the contamination coefficient α is compared with the image actualization coefficient β here, the image actualization coefficient β varies more with respect to the absolute moisture amount. Due to that, in a case when the electrification time t and the image ratio are constant, the service life determining portion 76 determines that the service life of the electrification roller 52 has come to the end earlier in the case when the absolute moisture amount calculated based on the detection result of the environment detection sensor 81 is small as compared to the case when the absolute moisture amount is large. Still further, in a case when the detection result of the environment detection sensor 81 and the electrification time t are constant, the service life determining portion 76 determines that the service life of the electrification roller 52 has come to the end earlier in the case when the image ratio of the image to be formed is large as compared to the case when the image ratio is small. Still further, in a case when the detection result of the environment detection sensor 81 and the image ratio are constant, the service life determining portion 76 determines that the service life of the electrification roller 52 has come to the end earlier in a case when the electrification time t is long as compared to a case when the electrification time t is short.

The cleaning blade coefficient C is a coefficient corresponding to a configuration of the cleaning blade 54 and varies depending on the configuration of the cleaning blade 54. That is, because a force of the cleaning blade 54 blocking the toner external additive varies depending on the linear pressure on the photosensitive drum 51 of the cleaning blade 54, an amount of the toner external additive slipping through the gap between the cleaning blade 54 and the photosensitive drum 51 varies and affects a degree of contamination of the electrification roller 52. Then, the linear pressure (g/cm$^2$) of the cleaning blade 54 on the photosensitive drum 51 is measured in advance and the cleaning blade coefficient C is found in connection with the linear pressure measured in advance by using the following Table 3:

TABLE 3

| | LINEAR PRESSURE (g/cm$^2$) | | | |
|---|---|---|---|---|
| | 20 | 25 | 30 | 35 |
| C | 0.98 | 1.00 | 1.01 | 1.02 |

It is noted that in the present embodiment, the cleaning blade 54 is provided with five load cells along a longitudinal direction thereof. Then, the cleaning blade 54 is caused to butt against the photosensitive drum 51 in advance of shipping the apparatus under the same condition with that in forming an image to measure linear pressures of the five load cells of the cleaning blade 54. Then, a minimum value among the five linear pressures obtained by the five load cells is adopted as the abovementioned linear pressure of the cleaning blade 54 in forming an image. Because the linear pressure varies depending on variation in dimension of components and on combination of the photosensitive drum 51 and others, the linear pressure is measured when the image forming portion 40 is assembled, the cleaning blade coefficient C is found from a measured value of the linear pressure by utilizing Table 3 and is stored in the memory portion 51*a* and others. It is noted that while a value obtained based on the linear pressure on the photosensitive drum 51 of the cleaning blade 54 is used as the cleaning blade coefficient C in the present embodiment, the present disclosure is not limited to such arrangement. For instance, torque of the photosensitive drum 51 pressed by the cleaning blade 54, an intrusion amount of the cleaning blade 54, and their environmental characteristics or the like may be utilized. It is noted that when the detection results of the environment detection sensor 81, the electrification time t, and the image ratio are constant, the service life determining portion 76 determines that the service life of the electrification roller 52 has come to the end earlier in a case when the linear pressure of the cleaning blade 54 is large as compared to a case when the linear pressure is small.

Then, the service life determining portion 76 determines whether or not an integrated value of the service life reaching rates LF exceeds 100% in step S9. When the service life determining portion 76 determines that the integrated value of the service life reaching rates LF exceeds 100%, the control portion 70 alarms by the error message informing that the replacement time of the electrification roller 52 has come close on the operating panel by the alarm portion 82 in step S10. This alarm makes it possible to inform the user that the time for replacing the electrification roller 52 has come or to inform a service man that an earlier service is required. If the service life determining portion 76 determines that the integrated service life reaching rate LF does not exceed 100%, the control portion 70 ends the process.

As described above, according to the image forming apparatus 1 of the present embodiment, the service life determining portion 76 determines whether or not the service life of the electrification roller 52 has come to the end based on the electrification voltage applied time obtained by the applied time timer 75 and the environmental information obtained by the environment detection sensor 81. Therefore, it is possible to estimate the service life with high accuracy corresponding to actual working conditions of the electrification roller 52 as compared to the case of estimating the amount of toner external additive depositing on the electrification roller 52 based of the integrated value of the electrification voltage applied time and the integrated value of number of rotations of the electrification roller 52.

Still further, according to the image forming apparatus 1 of the present embodiment, the service life determining portion 76 determines whether or not the service life of the electrification roller 52 has come to the end based also on the image ratio obtained by the image ratio calculation portion 77. Therefore, it is possible to estimate the service life of the electrification roller 52 with high accuracy corresponding to the actual working conditions of the electrification roller 52.

According also to the image forming apparatus 1 of the present embodiment, the service life determining portion 76 determines whether or not the service life of the electrification roller 52 has come to the end based also on the cleaning blade coefficient C related to the cleaning blade 54. Therefore, it is possible to estimate the service life of the electrification roller 52 with high accuracy corresponding to the actual working condition based also on the force of the cleaning blade 54 blocking the toner external additive on the surface of the photosensitive drum 51.

While the case in which the alarm portion 82 indicates the error message on the operating panel when the integrated service life reaching rate LF exceeds 100% has been described in the image forming apparatus 1 of the present embodiment described above, the present disclosure is not limited to such arrangement. For instance, it is also possible to arrange such that the alarm portion 82 issues a trigger for developing an automatic delivery system when the integrated service life reaching rate LF exceeds 100%.

Still further, the case when the service life determining portion 76 determines whether or not the service life of the electrification roller 52 has come to the end based also on the image ratio and the cleaning blade coefficient C, besides the electrification voltage applied time and the environment information, has been described in the image forming apparatus 1 of the present embodiment, the present disclosure is not limited to such arrangement. For instance, the service life determining portion 76 may determine the service life based only on either one of the image ratio and the cleaning blade coefficient C or without them.

EXAMPLES

Figure 5:
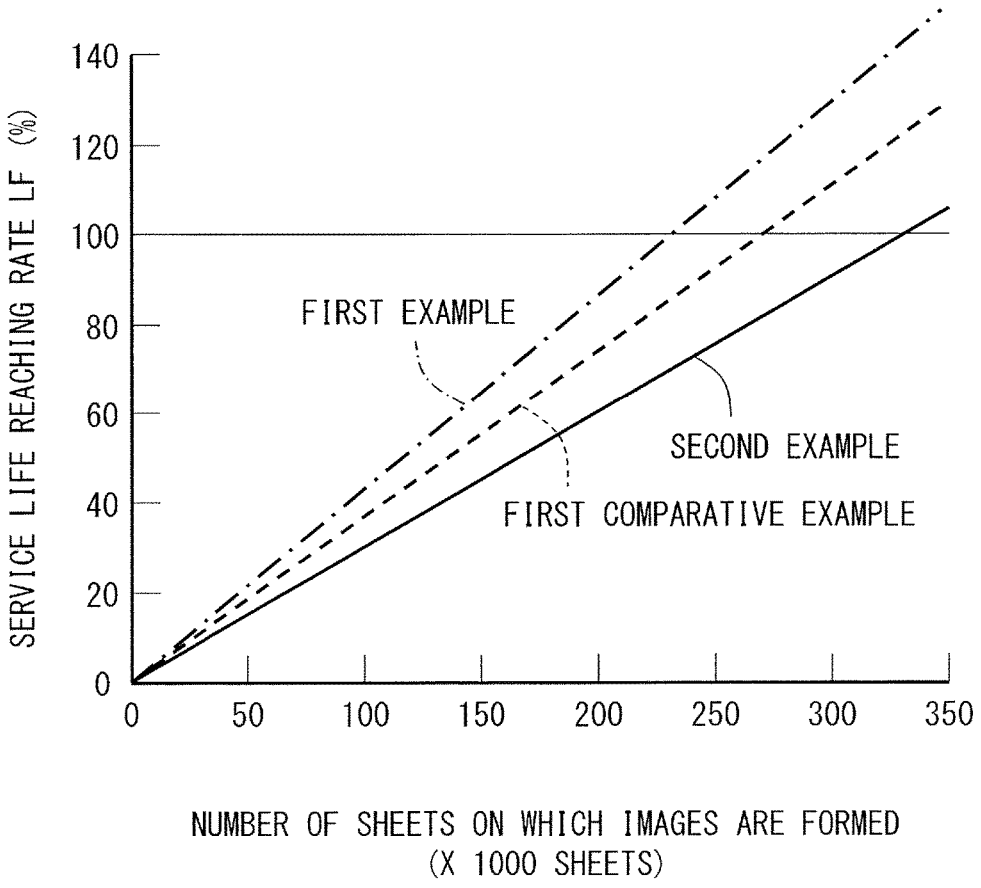
FIG. 5 is a graph indicating a relationship between a number of sheets on which images are formed and a service life reaching rate in different constant environment classes.

Here, a comparison was made on numbers of sheets by which the integrated value of the service life reaching rates LF exceeds 100% by repetitively executing an image forming process of five consecutive sheets with 5% of image ratio by using the image forming apparatus 1 of the present embodiment described above and by differentiating environmental conditions. A graph in FIG. 5 shows results of the comparison.

First Example

The abovementioned image forming process was executed under an environment equivalent to the environment class A, so that the environment detection sensor 81 selected the environment class A as an environment class. As a result, the integrated value of the service life reaching rates LF exceeded 100% at a point of time when the number of sheets on which images are formed was about 230×1000 sheets.

Second Example

The abovementioned image forming process was executed under an environment equivalent to the environment class G, so that the environment detection sensor 81 selected the environment class G as an environment class. As a result, the integrated value of the service life reaching rates LF exceeded 100% at a point of time when the number of sheets on which images are formed was about 330×1000 sheets.

First Comparative Example

The abovementioned image forming process was carried out under an arbitrary environment by setting an average environment class of the environment classes A, D and G as the environment class of the environment detection sensor 81. As a result, the integrated value of the service life reaching rates LF exceeded 100% at a point of time when the number of sheets on which images are formed was about 270×1000 sheets. In this case, a calculation result will be the same even if the image forming apparatus 1 is continuously used in the environment class A, and the integrated value of the service life reaching rates LF will exceed 100% when the number of sheets on which images are formed is about 270×1000 sheets. However, if the image forming apparatus 1 is actually continuously used in the environment class A, the integrated value of the service life reaching rates LF exceeds 100% when the number of sheets on which images are formed is about 230×1000 sheets, so that there is a possibility of causing defective images on and after the number of sheets on which images are formed of about 230×1000 sheets. Still further, if the image forming apparatus 1 is continuously used in the environment class G, the integrated value of the service life reaching rates LF exceeds 100% when the number of sheets on which images are formed is about 270×1000 sheets. However, if the image forming apparatus 1 is actually continuously used in the environment class G, the integrated value of the service life reaching rates LF exceeds 100% when the number of sheets on which images are formed is about 330×1000 sheets. Accordingly, there is a possibility of unnecessarily quickening the replacement time of the electrification roller 52, thus forcing a wasteful replacement.

Accordingly, it was confirmed to be possible by the image forming apparatus 1 of the present embodiment to improve the accuracy of the estimate control of the service life of the electrification roller 52 regardless of an usage environment and to realize an optimization of the timing of replacement made by the user, the timing of servicing made by the serviceman, the automatic delivery timing, and the like.

Figure 6:
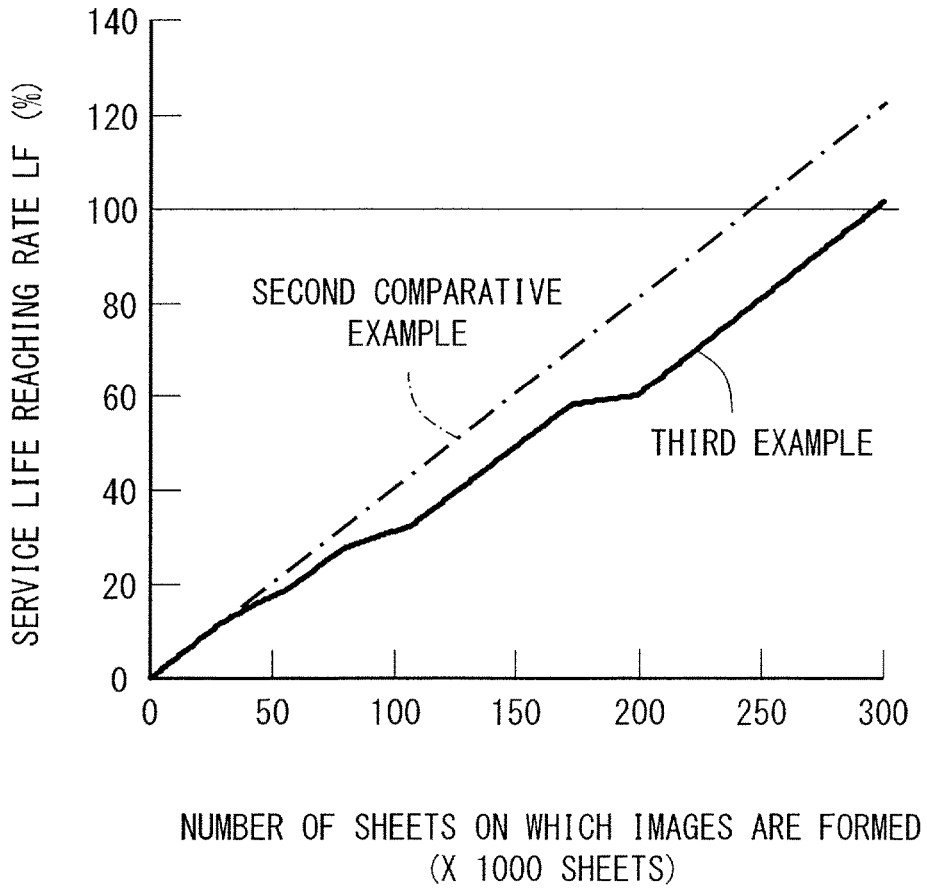
FIG. 6 is a graph indicating the relationship between the number of sheets on which images are formed and the service life reaching rate in a case when the environment class changes.

Next, a comparison was made on numbers of sheets by which the integrated value of the service life reaching rates LF exceeds 100% by repetitively executing the image forming process of five consecutive sheets with 5% of image ratio by using the image forming apparatus 1 of the present embodiment described above and by differentiating environmental conditions. A graph in FIG. 6 shows results of the comparison.

Third Example

The abovementioned image forming process was executed by changing the environment corresponding to the environment classes A through D per every number of sheets on which images are formed of about 50×1000 sheets to about 70×1000 sheets. The environment detection sensor 81 changeably selected the environment classes A through D as an environment class. As a result, the integrated value of the service life reaching rates LF exceeded 100% at a point of time when the number of sheets on which images are formed was about 300×1000 sheets.

Second Comparative Example

The abovementioned image forming process was carried out under an environment similar to that of the third example by setting the environment class A as the environment class of the environment detection sensor 81. As a result, the integrated value of the service life reaching rates LF exceeded 100% at a point of time when the number of sheets on which images are formed was about 250×1000 sheets. In this case, a calculation result will be the same even if the image forming apparatus 1 is used under the similar environment, and the integrated value of the service life reaching rates LF will exceed 100% when the number of sheets on which images are formed is about 250×1000 sheets. However, if the image forming apparatus 1 is actually used under the same environment with that of the third example, the integrated value of the service life reaching rates LF exceeds 100% when the number of sheets on which images are formed is about 300×1000 sheets, so that there is a possibility of unnecessarily quickening the replacement time of the electrification roller 52, thus forcing a wasteful replacement.

Accordingly, it was confirmed that it is possible by the image forming apparatus 1 of the present embodiment to improve the accuracy of the estimate control of the service life of the electrification roller 52 regardless of the usage environment and to realize the optimization of the timing of replacement made by the user, the timing of servicing made by the service man, the automatic delivery timing, or the like. While the usage environment often varies corresponding to seasons in an actual usage environment, it was confirmed that the image forming apparatus 1 of the present embodiment can estimate the service life of the electrification roller 52 with high accuracy even in such cases.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-160929, filed Aug. 18, 2015 which is hereby incorporated by reference herein in its entirety.

What is claimed is:

1. An image forming apparatus, comprising:

an apparatus body;

an image bearing member arranged in the apparatus body;

an electrification member arranged in the apparatus body and configured to be in contact with a surface of the image bearing member to electrify the image bearing member;

an electrostatic latent image forming portion arranged in the apparatus body and configured to form an electrostatic latent image on the electrified image bearing member based on image information;

an image forming portion arranged in the apparatus body and configured to form an image on a recording medium based on the electrostatic latent image formed on the image bearing member;

an environment detecting portion configured to detect environmental information in the apparatus body;

a service life determining portion configured to determine whether or not a service life of the electrification member has come to its end based on information concerning an electrification time during which voltage is applied to the electrification member obtained by using a detection result of the environment detecting portion and information concerning an image ratio of a formed image obtained by using the detection result of the environment detecting portion; and an alarm portion configured to issue an alarm in response to a determination made by the service life determining portion that the service life of the electrification member has come to the end.

2. The image forming apparatus according to claim 1, further comprising:

a measuring portion configured to measure a time during which voltage is applied to the electrification member; and an image ratio calculation portion configured to calculate the image ratio of the image formed on the image bearing member, wherein the service life determining portion is configured to calculate a determination value by using an output of the measuring portion, an output of the image ratio calculation portion, and an output of the environment detecting portion per every predetermined number of images formed on recording media.

3. The image forming apparatus according to claim 2, wherein the service life determining portion is configured to determine that the service life of the electrification member has come to the end if the accumulated determination value reaches a predetermined value.

4. The image forming apparatus according to claim 1, further comprising a cleaning portion configured to clean developer left on the surface of the image bearing member, wherein the service life determining portion is configured to determine whether or not the service life of the electrification member has come to the end based on a coefficient related to cleaning performance of the cleaning portion.

5. The image forming apparatus according to claim 4, wherein the cleaning portion comprises a cleaning blade coming into contact with a surface of the image bearing member and the coefficient is related to linear pressure of the cleaning blade on the image bearing member.

6. The image forming apparatus according to claim 5, wherein the service life determining portion is configured to determine that the service life of the electrification member has come to the end earlier in a case where the linear pressure of the cleaning blade is large as compared to a case where the linear pressure is small, if detection results of the environment detecting portion, the electrification time, and the image ratio are constant.

7. The image forming apparatus according to claim 4, wherein the cleaning portion comprises a cleaning blade coming into contact with a surface of the image bearing member and the coefficient is related to torque of the image bearing member pressed by the cleaning blade.

8. The image forming apparatus according to claim 4, further comprising a memory portion, the memory portion storing the coefficient related to the cleaning performance.

9. The image forming apparatus according to claim 1, wherein the environment detecting portion detects temperature and humidity as the environmental information, and wherein the service life determining portion is configured to determine that the service life of the electrification member has come to the end earlier in a case where an absolute moisture amount calculated based on detection results of the environment detecting portion is small as compared to a case where the absolute moisture amount is large, if the electrification time and the image ratio are constant.

10. The image forming apparatus according to claim 1, wherein the service life determining portion is configured to determine that the service life of the electrification member has come to the end earlier in a case where the image ratio of the image to be formed is large as compared to a case where the image ratio is small, if detection results of the environment detecting portion and the electrification time are constant.

11. The image forming apparatus according to claim 1, wherein the service life determining portion is configured to determine that the service life of the electrification member has come to the end earlier in a case where the electrification time is long as compared to a case where the electrification time is short if detection results of the environment detecting portion and the image ratio are constant.

12. An image forming apparatus comprising:

an apparatus body;

an image bearing member arranged in the apparatus body;

a charging member, arranged in the apparatus body, configured to charge the image bearing member in contact with the image bearing member;

an electrostatic latent image forming portion configured to form an electrostatic latent image on the charged image bearing member based on image information;

an image forming portion, arranged in the apparatus body, configured to form an image on a recording medium based on the electrostatic latent image formed on the image bearing member;

an environment detecting portion configured to detect environmental information in the apparatus body; and a determining portion configured to determine whether an accumulated value, obtained by accumulating a calculated value while the charging member is arranged in the apparatus body, reaches a predetermined value, the calculated value being calculated based on an image ratio of an image formed on the charged image bearing member by the charging member and a detection result of the environment detecting portion.

13. The image forming apparatus according to claim 12, further comprising:

a measuring portion configured to measure an applied time during which voltage is applied to the charging member; and an image ratio calculation portion configured to calculate the image ratio of the image formed on the image bearing member, wherein the calculated value is calculated based on the image ratio, the detection result of the environment detecting portion, and a value concerning the applied time measured by the measuring portion.

14. The image forming apparatus according to claim 13, wherein an absolute value of the calculated value becomes larger in a case where the value concerning the applied time measured by the measuring portion becomes larger.

15. The image forming apparatus according to claim 12, further comprising a cleaning portion configured to remove developer on a surface of the image bearing member, wherein the calculated value is calculated based on the image ratio, the detection result of the environment detecting portion, and a coefficient related to cleaning performance of the cleaning portion.

16. The image forming apparatus according to claim 15, wherein the cleaning portion comprises a cleaning blade coming into contact with the image bearing member and the coefficient is related to linear pressure of the cleaning blade on the image bearing member.

17. The image forming apparatus according to claim 15, wherein the cleaning portion comprises a cleaning blade coming into contact with the image bearing member and the coefficient is related to torque of the image bearing member pressed by the cleaning blade.

18. The image forming apparatus according to claim 15, further comprising a memory portion, the memory portion storing the coefficient related to the cleaning performance.

19. The image forming apparatus according to claim 12, wherein the environment detecting portion is configured to detect an absolute moisture amount.

20. The image forming apparatus according to claim 19, wherein an absolute value of the calculated value becomes larger in a case where the absolute moisture amount becomes larger.

21. The image forming apparatus according to claim 12, wherein an absolute value of the calculated value becomes larger in a case where the image ratio becomes larger.

22. An image forming apparatus comprising:

an apparatus body;

an image bearing member arranged in the apparatus body;

a charging member, arranged in the apparatus body, configured to charge the image bearing member in contact with the image bearing member;

an electrostatic latent image forming portion configured to form an electrostatic latent image on the charged image bearing member based on image information;

an image forming portion, arranged in the apparatus body, configured to form an image on a recording medium based on the electrostatic latent image formed on the image bearing member;

an environment detecting portion configured to detect environmental information in the apparatus body; and an alarm portion configured to issue an alarm in a state where an accumulated value, obtained by accumulating a calculated value while the charging member is arranged in the apparatus body, reaches a predetermined value, the calculated value being calculated based on an image ratio of an image formed on the charged image bearing member by the charging member and a detection result of the environment detecting portion.

23. The image forming apparatus according to claim 22, wherein the alarm portion comprises a display portion configured to display an indication concerning replacement of the charging member.

24. The image forming apparatus according to claim 22, further comprising:

a measuring portion configured to measure an applied time during which voltage is applied to the charging member; and an image ratio calculation portion configured to calculate the image ratio of the image formed on the image bearing member, wherein the calculated value is calculated based on the image ratio, the detection result of the environment detecting portion, and a value concerning the applied time measured by the measuring portion.

25. The image forming apparatus according to claim 24, wherein an absolute value of the calculated value becomes larger in a case where the value concerning the applied time measured by the measuring portion becomes larger.

26. The image forming apparatus according to claim 22, further comprising a cleaning portion configured to remove developer on a surface of the image bearing member, wherein the calculated value is calculated based on the image ratio, the detection result of the environment detecting portion, and a coefficient related to cleaning performance of the cleaning portion.

27. The image forming apparatus according to claim 26, wherein the cleaning portion comprises a cleaning blade coming into contact with the image bearing member and the coefficient is related to linear pressure of the cleaning blade on the image bearing member.

28. The image forming apparatus according to claim 26, wherein the cleaning portion comprises a cleaning blade coming into contact with the image bearing member and the coefficient is related to torque of the image bearing member pressed by the cleaning blade.

29. The image forming apparatus according to claim 26, further comprising a memory portion, the memory portion storing the coefficient related to the cleaning performance.

30. The image forming apparatus according to claim 22, wherein the environment detecting portion is configured to detect an absolute moisture amount.

31. The image forming apparatus according to claim 30, wherein an absolute value of the calculated value becomes larger in a case where the absolute moisture amount becomes larger.

32. The image forming apparatus according to claim 22, wherein an absolute value of the calculated value becomes larger in a case where the image ratio becomes larger.

33. An image forming apparatus comprising:

an apparatus body;

an image bearing member arranged in the apparatus body;

a charging member arranged in the apparatus body and configured to charge the image bearing member through contact with the image bearing member;

an electrostatic latent image forming portion configured to form an electrostatic latent image on the charged image bearing member based on image information;

an image forming portion arranged in the apparatus body and configured to form an image on a recording medium based on the electrostatic latent image formed on the image bearing member;

an environment detecting portion configured to detect environmental information in the apparatus body; and an alarm portion configured to issue an alarm concerning replacement of the charging member based on an image ratio or an image amount of an image formed on the charged image bearing member and a detection result of the environment detecting portion.

34. The image forming apparatus according to claim 33, wherein the alarm portion is comprises a display portion configured to display an indication concerning the replacement of the charging member.

35. The image forming apparatus according to claim 33, wherein the alarm portion is configured to issue the alarm concerning the replacement of the charging member based on the image ratio or the image amount, the detection result of the environment detecting portion, and a voltage applied time during which voltage is applied to the charging member.

36. The image forming apparatus according to claim 33, further comprising a cleaning portion configured to remove developer on a surface of the image bearing member, wherein the alarm portion is configured to issue the alarm concerning the replacement of the charging member based on the image ratio or the image amount, the detection result of the environment detecting portion, and a coefficient related to cleaning performance of the cleaning portion.

37. The image forming apparatus according to claim 36, wherein the cleaning portion comprises a cleaning blade coming into contact with the image bearing member and the coefficient is related to linear pressure of the cleaning blade on the image bearing member.

38. The image forming apparatus according to claim 36, wherein the cleaning portion comprises a cleaning blade coming into contact with the image bearing member and the coefficient is related to torque of the image bearing member pressed by the cleaning blade.

39. The image forming apparatus according to claim 36, further comprising a memory portion, the memory portion storing the coefficient related to the cleaning performance.

40. The image forming apparatus according to claim 33, wherein the environment detecting portion is configured to detect an absolute moisture amount.

41. The image forming apparatus according to claim 33, wherein the alarm portion issues the alarm earlier in a case where the image ratio or the image amount is large as compared to a case where the image ratio or the image amount is small.

* * * * *